United States Patent [19]

Ottenheimer

[11] Patent Number: 5,005,378

[45] Date of Patent: Apr. 9, 1991

[54] LIQUID CHILLING APPARATUS

[76] Inventor: Charles J. Ottenheimer, 1128 Ala Napunani, Suite 1105, Honolulu, Hi. 96818

[21] Appl. No.: 507,602

[22] Filed: Apr. 10, 1990

[51] Int. Cl.[5] ..... F25D 25/00

[52] U.S. Cl. ..... 62/378; 62/381; 62/457.8

[58] Field of Search ..... 62/378, 379, 381, 457.8, 62/372

[56] References Cited

U.S. PATENT DOCUMENTS 507,996 11/1893 Cobin et al. ..... 62/378 X
511,209 12/1893 Parker ..... 62/378
2,817,458 12/1957 Amigone ..... 62/381 X
4,825,665 5/1989 Micallef ..... 62/457.8 X

*Primary Examiner*—Lloyd L. King
*Attorney, Agent, or Firm*—Quirk, Tratos & Roethel

[57] ABSTRACT

An apparatus for the rapid chilling of bottled liquids, the apparatus being adapted to support and rotate the bottle in a low temperature medium contained in a bucket. The apparatus comprising a gear drive mechanism supported on a bridge over the bucket and a bottle neck gripping device coupled to the drive shaft of the gear drive mechanism beneath the bridge. The bottle neck gripping device supporting the bottle in the chilling medium and rotating the bottle in response to rotation of the gear drive shaft.

11 Claims, 2 Drawing Sheets

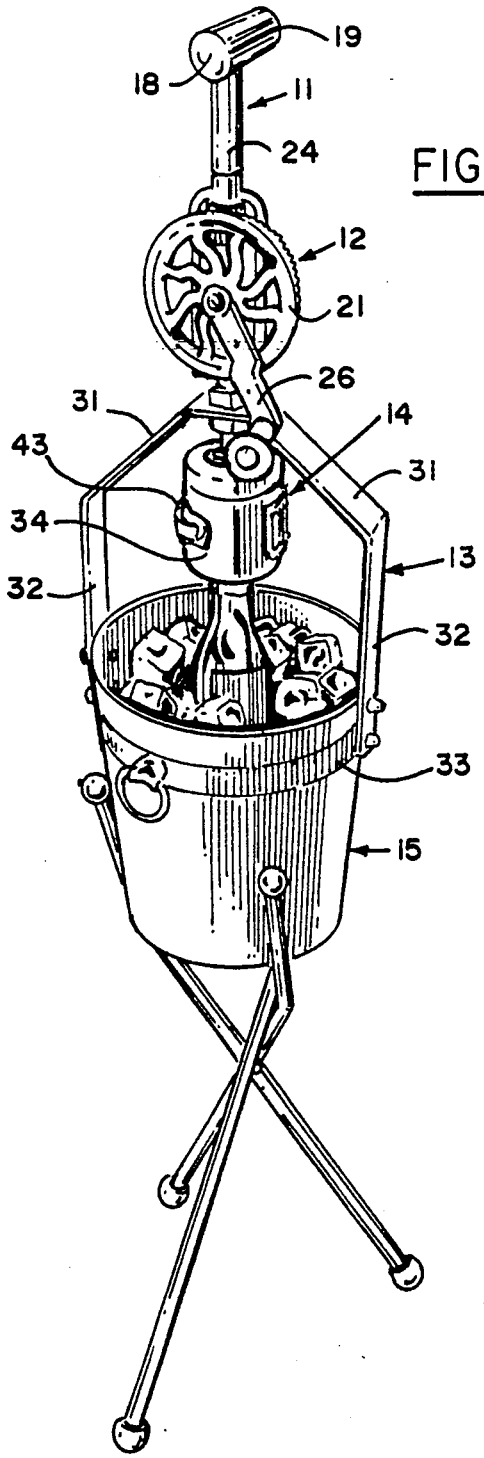
FIGURE 1.
FIGURE 2.
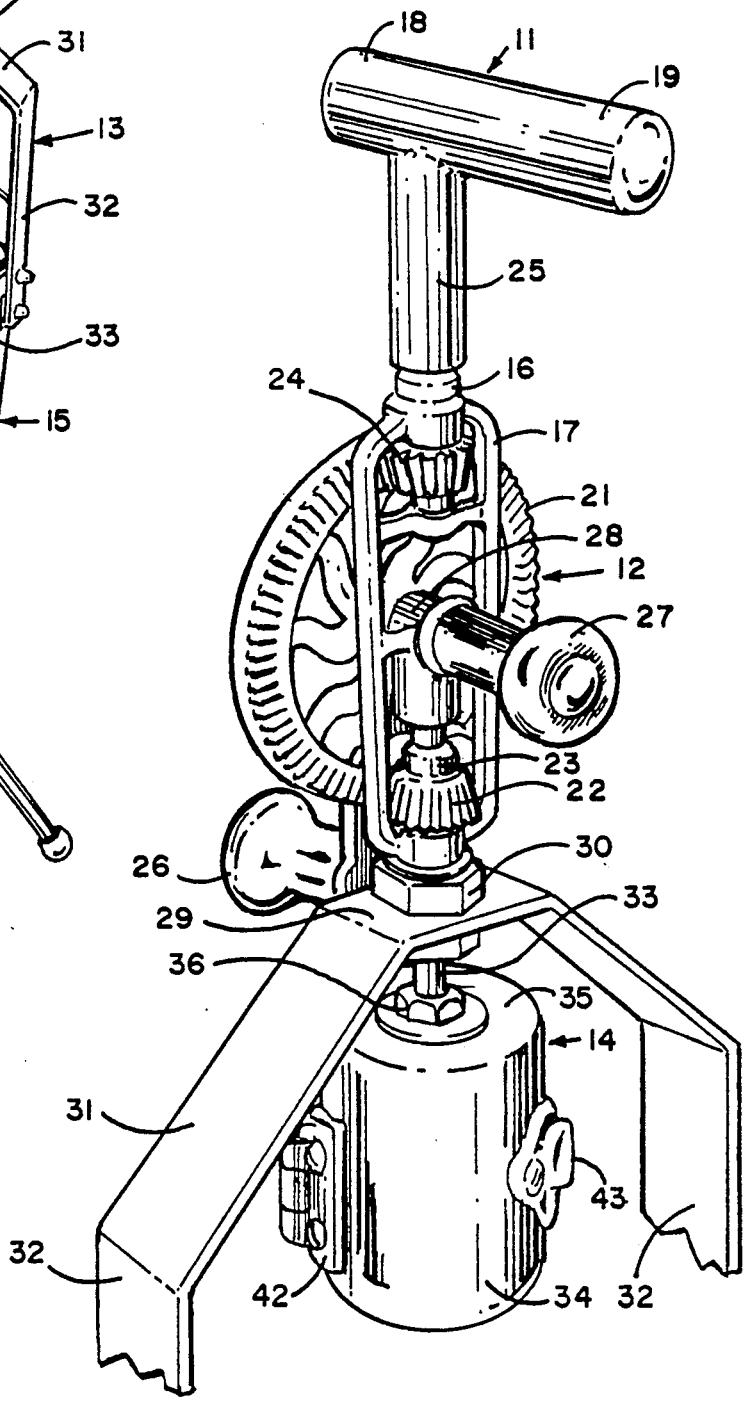

LIQUID CHILLING APPARATUS

BACKGROUND OF THE INVENTION

This invention relates to an apparatus for the rapid chilling of liquids in opened or unopened bottles.

The utility of an apparatus for the rapid chilling of bottled liquids, such as still or sparkling wines, in the home as well as in commercial restaurants at once will be obvious In the home, the refrigerator can be relieved of it's wine chilling function and the space otherwise occupied by wine bottles used for food chilling and preservation. In commercial restaurants, wine lists can be expanded since refrigeration is no longer a main consideration. Slow moving wine inventory will not have to be chilled for weeks or months before it is used.

Accordingly, it is an object of the present invention to provide a chilling apparatus for bottled liquids that is small, durable, light weight inexpensive to manufacture, functional and attractive to observe.

It is a further object to provide a chilling apparatus for bottled liquids that can be operated without hazard to the operator or to anyone standing or sitting near it during it's operation.

It is yet a further object to provide a chilling apparatus that can be manually operated and therefore is not reliant on electric power sources. It then can be used both indoors and outdoors.

It is yet a further object to provide a chilling apparatus that does not require compressed gas of any kind in its operation, does not emit any noxious odors and does not create any loud or unpleasant noises while being operated.

These and other objects of the invention will be apparent from the following disclosure of the preferred embodiment of the present invention.

SUMMARY OF THE INVENTION

This invention provides a liquid chilling apparatus for supporting and rotating a bottle, such as an unopened or sealed bottle containing a still or sparkling wine, in a bucket containing a chilling medium that is at a temperature lower than that of the bottle contents. The apparatus comprises a bridge mounted on the bucket. The bridge supports a drive mechanism that is coupled to a bottle gripping device that is adapted to be clamped on the neck of the bottle. The drive mechanism coacts with the bottle gripping device to support and rotate the bottle in the chilling medium.

BRIEF DESCRIPTION OF THE DRAWINGS

The invention is best understood with reference to the drawings, in which:

FIG. 1 is a perspective view of the bottle chilling apparatus embodying the present invention;

FIG. 2 is an enlarged perspective view of the drive mechanism and the bottle gripping device coupled to the drive mechanism;

DETAILED DESCRIPTION OF THE INVENTION

Figure 3:
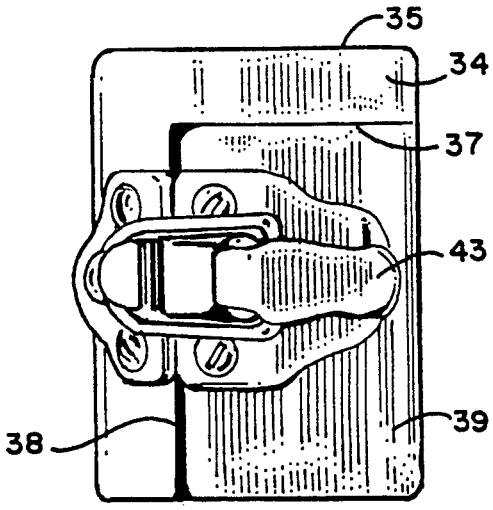
FIG. 3 is a side elevation of the bottle gripping device showing the latch mechanism for latching a hinged section of the tubular bottle gripping device.
Figure 4:
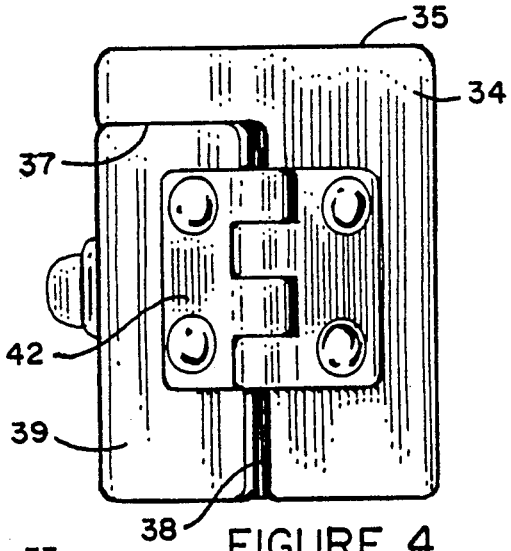
FIG. 4 is a side elevation of the bottle gripping device showing the hinge for the hinged section.

Referring first to FIG. 1, the liquid chilling apparatus, generally designated 10, for chilling the contents of opened or unopened bottles, such as wine bottles containing still or sparkling wines, comprises from top to bottom a carrying or steadying handle 11 for right or left hand operation, a gear train drive mechanism 12, a bridge or bail 13, a bottle neck gripping device !4 and a container or bucket 15.

The carrying o steadying handle 11 is secured to the top 16 of the framework 17 on which the drive mechanism 12 is mounted. The handle 11 is a modified "T" with one leg 18 of the cross bar being a substantially short stub compared to the other leg 19. The purpose of this configuration is to provide a handle for carrying the apparatus and also for steadying it while being operated. The stub end 18 will allow for the unimpeded turning of the geared drive wheel 21 of the geared drive train 12. Preferably, the handle is grasped with the thumb looped beneath the handle stub 18 with the rest of the steadying hand grasping the longer handle portion 19. The device is readily operable by either right or left handed persons depending upon which side of the apparatus the person stands while operating it.

Beneath the handle 11 is the gear train drive mechanism 12, the parts of which are journalled on the support frame 17. Preferably, the gear train comprises a lower or base cone gear 22 coupled to an output drive shaft 23. A second cone gear 24 is journalled on the support frame 17 below the connection 16 of the vertical handle shaft 25. The cone gear 24 is an idler gear that acts as a balancing member for the gear wheel 21 that meshes with cone gear 22/drive shaft 23 assembly on the bottom and the balancing cone gear 24 on the top. The geared wheel 21 meshes with both cone gears and when turned the drive shaft 23 coupled to the base cone gear 22 is also turned. The geared wheel 21 preferably is turned by operation of crank handle 26 but could be rotated by a power drive unit (not shown). An auxiliary handle 27 is shown that is mounted on an extension of the axle 28 on which the geared wheel 21 is journalled. The only function of this handle is to provide an alternate stabilizing handle to grasp during operation of the apparatus.

At the point at which the vertical driveshaft 23 penetrates the horizontal section 28 of the bridge or bail 13 a suitable bushing 30 is provided through which the drive shaft is journalled. The bushing 30 allows the drive shaft 23 to freely rotate when driven by the gear train.

The bridge or bail 13 is a spacing part which has above it the geared drive train 12 and beneath it the container or bucket 15. The bridge or bail 13 rigidly spans the container or bucket 15. From its horizontal section 29 the bridge has downwardly angularly inclined sections 31 terminating in vertical side members 32 bolted or otherwise secured to the upper perimeter 33 of the bucket 15. The bridge or bail 13 is configured not only to rigidly support the drive train 12, but also to support it at such a height as to allow the bottle neck gripping device 14 to be attached to the lower end 33 of the drive shaft 23 in position to receive a bottle of liquid to be chilled. The point of connection between the bottle neck gripping device 14 and the drive shaft 23 centers the gripping device directly over the center of the container or bucket 15.

The bottle neck gripping device 14 is a cylindrical tube 34 having a cap 35 on its top end and being open at its bottom end. The lower end 33 of the drive shaft 23 is threaded into a jam nut 36 that is welded or staked to the upper surface of the tube cap 35. The bottle neck gripping device 14, accordingly, revolves with the drive shaft 23 at the same revolutions per minute that the drive shaft is driven by rotation of the gear train drive mechanism 12, which may be more than 200 revolutions per minute.

Beneath the top or cap 35 of the cylindrical tube 34 there is a horizontal incision 37 half-way through the tube body. At the terminus of each end of the horizontal incision 37 there is a vertical incision 38 going to the bottom end of the tube 34 thus creating a door 39 for enclosing the hollow interior or chamber 41 of the cylindrical tube 34. The door 39 is hinged on one of the vertical incisions 38 by a hinge device 42 and has a latch 43 on the side opposite the hinge mounting. When the door 39 is closed the interior of the cylindrical tube 34 becomes a bottle neck receiving chamber 41.

At the lower end of the chamber 4!, on both the concave inner surface of the door 39 and the interior wall of the tube 34 there is a fabric or elastomeric lining 44. The lining material is moderately supple or spongy and of such thickness as to reduce the circular shape of the interior to such a degree that when a bottle neck is inserted into the chamber 41 and the door 39 is latched, the supple lining creates a seal around the neck of the bottle and firmly grasps the bottle. Further, the fabric on the lining has non-skid properties so that the bottle neck is not only firmly held but will not slip when the entire bottle is rotated in the chilling medium.

Figure 5:
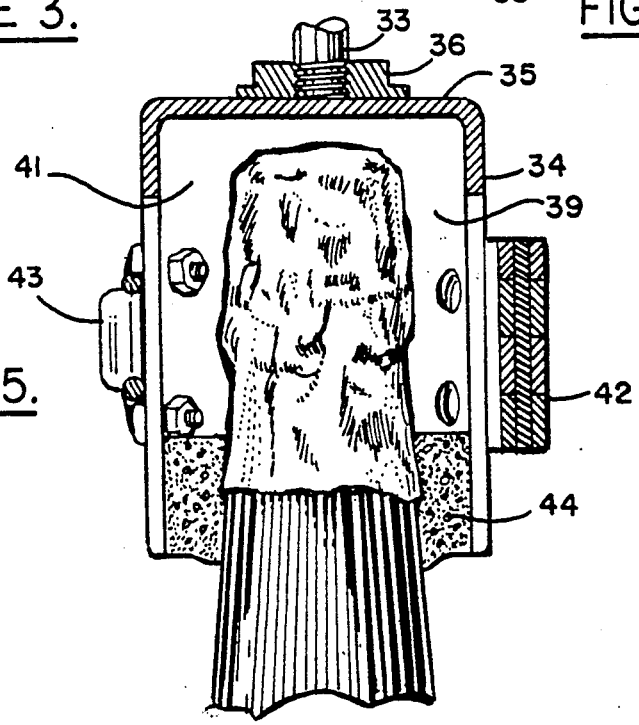
FIG. 5 is a cutaway view of the tubular bottle gripping device showing the top of a bottle in the bottle neck receiving chamber with the cork on the bottle extending into a cork cavity.
Figure 6:
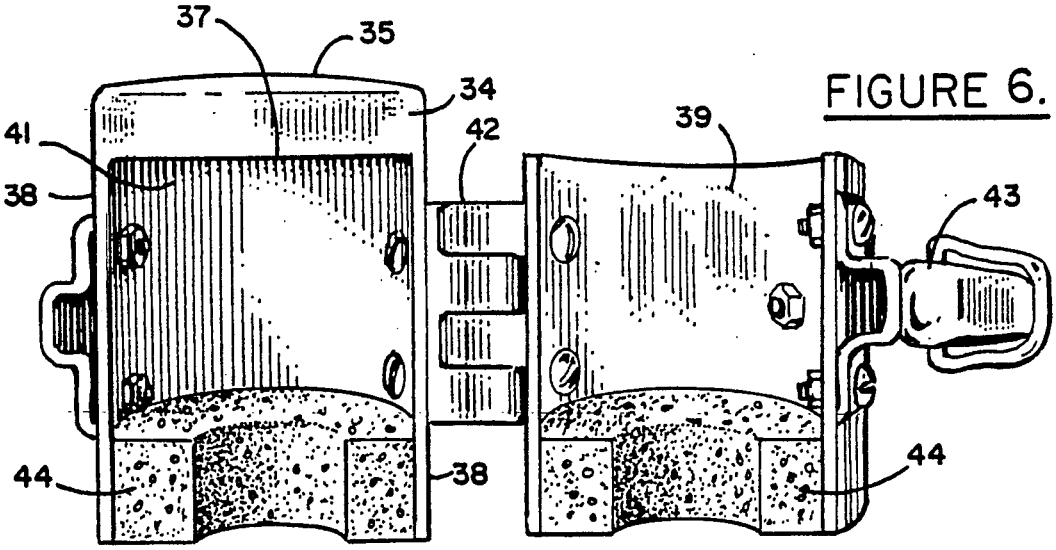
FIG. 6 is a view showing the bottle gripping device in an open position prior to the insertion of a bottle neck into the bottle neck receiving chamber and the empty cork cavity.

There is space in the chamber above the lining that forms a cork cavity, see FIG. 5. The cork cavity accommodates large corks and a range of bottle necks of varying lengths. The cork cavity in combination with the spongy lining allows the bottle neck gripping device 1 to accommodate the variety of bottles used by the bottlers of still and sparkling wines.

The container or bucket 15 is the bottom-most part of the liquid chilling apparatus 10 embodying the present invention. In use, the bottle to be chilled is introduced into the container or bucket 15 with the door 39 in an open position. The neck of the bottle is moved laterally into the bottle neck receiving chamber 41 and the door 39 closed and latched. The chilling medium, which in most cases is crushed or cubed ice, is spread around the body of the bottle at least up to the ullage level. Most bottles will be supported in the bucket in a suspended condition in the cooling medium. There will be little frictional resistance to the rotation of the bottle especially when submerged in the ice or ice water. Rotation of the gear wheel 21 causes the liquid containing bottle to spin with a resultant transfer of heat from the bottle contents to the bucket contents until temperature equilibrium is reached between the bottle contents and the bucket contents.

While the invention has been illustrated with respect to a specific embodiment thereof, this embodiment should be considered as illustrative rather than limiting. Various modifications and additions may be made and will be apparent to those skilled in the art. Accordingly, the invention should not be limited by the foregoing description, but rather should be defined only by the following claims.

What is claimed:

1. A liquid chilling apparatus for supporting and rotating a bottle in a bucket containing a chilling medium that is at a temperature lower than that of the bottle contents, comprising:

(a) a bridge adapted to be mounted on the bucket;

(b) a drive mechanism mounted on the bridge, the drive mechanism having a drive shaft projecting through the bridge; and (c) a bottle gripping device coupled to the drive shaft beneath the bridge and adapted to be clamped on the neck of a bottle to support the bottle in the chilling medium for rotation by the drive mechanism, the bottle gripping device comprising a cylindrical tube housing a bottle neck receiving chamber having at its lower end an elastomeric compressible lining therein;

the cylindrical tube being open at its bottom end and having a hinged wall portion extending upwardly from the open end, the hinged wall portion being swingable into a position to provide a lateral access opening into the chamber, and latch means for securing the hinged wall portion in chamber closed position with the lining compressed about the bottle neck.

2. A liquid chilling apparatus according to claim 1, in which:

the cylindrical tube has a cap on its upper end to which the drive shaft is connected.

3. A liquid chilling apparatus according to claim 1, in which:

the elastomeric lining is compressible to accommodate a range of bottle neck sizes.

4. A liquid chilling apparatus according to claim 1, in which:

the bottle neck receiving chamber is of sufficient height to accommodate bottle necks of varying lengths between the shoulder and the lip of the bottle.

5. A liquid chilling apparatus according to claim 1, in which:

the size of the bottle neck receiving chamber above the compressible lining is large enough to accommodate bottles with oversize corks.

6. A liquid chilling apparatus according to claim 1, in which:

the bottle neck receiving chamber is of sufficient height to accommodate bottles of varying lengths between the bottle shoulder and the bottle lip; and the size of the upper portion of the bottle neck receiving chamber is large enough to accommodate oversize corks on the bottles.

7. A liquid chilling apparatus according to claim 1, in which:

the compressible lining accommodates a range of bottle neck sizes; and the size of the bottle neck receiving chamber above the compressible lining is large enough to accommodate bottles having oversize corks.

8. A liquid chilling apparatus according to claim 1, in which:

ice is the temperature changing medium in the bucket, the depth of the bucket is such that the ice substantially surrounds the bottle to the ullage level of the liquid contained therein.

9. A liquid chilling apparatus according to claim 8, in which:

the grip of the compressible liner on the bottle neck is sufficient to withstand more than a 200 revolutions per minute rotation of the bottle in the ice filled bucket by the drive mechanism.

10. A liquid chilling apparatus for supporting and rotating a bottle in a container containing a chilling medium that is at a lower temperature than the bottle contents, comprising:

a connection bridge straddling the container, a gear train drive mechanism mounted on the top of the connection bridge having a drive shaft extension extending below the bridge, a bottle neck gripping device comprising a cylindrical tube having at its upper end coupler means for connecting the bottle neck gripping device to the drive shaft extension, a bottle neck receiving chamber in the cylindrical tube open at the bottom and having a hinged wall portion providing lateral access to the chamber, the interior of the bottle neck receiving chamber being lined at its lower end with a compressible lining adapted to tightly grip the neck of a bottle, whereby the bottle is supported in the chilling medium for rotation by the drive mechanism.

11. A liquid chilling apparatus according to claim 10, in which:

a latch means is mounted on the exterior of the cylindrical tube for securing the hinged wall portion in chamber closed position and creating the requisite lining pressure against the bottle neck.

* * * * *